US006851132B1

(12) United States Patent
Jones-Lowe

(10) Patent No.: US 6,851,132 B1
(45) Date of Patent: Feb. 8, 2005

(54) CUSHIONED BED PAN

(76) Inventor: Cynthia L. Jones-Lowe, 6715 Gude Ave., Takoma Park, MD (US) 20912

( * ) Notice: Subject to any disclaimer, the term of this patent is extended or adjusted under 35 U.S.C. 154(b) by 0 days.

(21) Appl. No.: 10/178,173

(22) Filed: Jun. 24, 2002

(51) Int. Cl.[7] ..... A61G 9/00
(52) U.S. Cl. ..... 4/456
(58) Field of Search ..... 4/456

(56) References Cited

U.S. PATENT DOCUMENTS

| | | | | |
|---|---|---|---|---|
| 2,817,093 A | * | 12/1957 | Rode | 4/456 |
| 3,462,770 A | | 8/1969 | Smith | |
| 3,514,793 A | | 6/1970 | West | |
| 3,939,502 A | | 2/1976 | Miller | |
| 4,827,540 A | | 5/1989 | Stokes | |
| 4,899,399 A | | 2/1990 | Young | |
| 5,079,788 A | | 1/1992 | Raupp | |
| 5,867,845 A | * | 2/1999 | Fangmann | 4/456 |
| 5,951,366 A | | 9/1999 | Stevens | |
| 6,256,804 B1 | | 7/2001 | Stevens | |

FOREIGN PATENT DOCUMENTS

| | | | | |
|---|---|---|---|---|
| CA | 524125 | * | 4/1956 | 4/456 |

* cited by examiner

*Primary Examiner*—Charles E. Phillips
(74) *Attorney, Agent, or Firm*—John D. Gugliotta; Olen L. York, III

(57) ABSTRACT

A padded seat is provided, similar to a toilet seat, that is attached or clipped to a conventional bedpan. Friction fit snaps are provided for attaching the padded cushion to a bedpan. The snap on/snap off design extends the versatility of existing bedpans while remaining easy to empty and clean. The padded nature is not only more physically comfortable for the user, it also provides a psychological advantage for those who find it difficult to use a bedpan as well.

12 Claims, 3 Drawing Sheets

CUSHIONED BED PAN

RELATED APPLICATIONS

The present invention was first described in Disclosure Document Registration 503,654 filed on Jan. 11, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to bedpans and, more particularly, to a cushioned, grip engaging arcuate member for use with existing bedpans.

2. Description of the Related Art

Patients who are ill and confined to bed as a result of an illness, disability or accident are faced with obstacles on a daily basis that most of us take for granted. Just the simple act of going to the bathroom can be a major undertaking for them as well as their care providers. While such items as a bed pan may make the task easier by not requiring the user to physically travel to a bathroom facility, they still require the patient to precariously position themselves to perform bathroom duties. Such situations are not only physically uncomfortable, they are also a psychological burden which may actually affect the patient's ability to relieve themselves. These situations put additional worry and stress not only on the patient, but the care giver as well.

A search of the prior art did not disclose any patents that read directly on the claims of the instant invention; however, the following references were considered related.

U.S. Pat. No. 6,256,804 issued in the name of Stevens, describes a pillow-like protector and body support device.

U.S. Pat. No. 5,951,366 issued in the name of Stevens, describes a pillow-like protector and body support device.

U.S. Pat. No. 5,079,788 issued in the name of Raupp, describes a bedpan which provides ease of use through its low lying configuration.

U.S. Pat. No. 4,899,399 issued in the name of Young, describes a inflatable bedpan apparatus and method.

U.S. Pat. No. 4,827,540 issued in the name of Stokes, describes a disposable combination bedpan cushion and waste bag assembly U.S. Pat. No. 3,939,502 issued in the name of Miller, describes a disposable comfort pad for bedpans.

U.S. Pat. No. 3,514,793, issued in the name of West, describes a multi-cushioned bedpan seat.

U.S. Pat. No. 3,462,770 issued in the name of Smith, describes a washable bedpan with a flexible, yielding cushion seat of horseshoe shape.

Consequently, there exists a need for a means by which the functionality of a conventional bed pan can be increased to address the shortcomings as listed above.

SUMMARY OF THE INVENTION

It is therefore an object of the present invention to provide an improved bedpan.

It is a feature of the present invention to provide a cushioned, grip engaging arcuate member for use with existing bedpans.

Briefly described according to one embodiment of the present invention, a padded seat, similar to a toilet seat, that is attached or clipped to a conventional bedpan is provided.

Upon initial observation, the invention looks like a conventional toilet seat with foam padding and a plastic vinyl cover. However, after closer inspection, it can be seen that friction fit snaps are provided for attaching the padded cushion to a bedpan. The snap on/snap off design extends the versatility of existing bedpans while remaining easy to empty and clean. The padded nature is not only more physically comfortable for the user, it also provides a psychological advantage for those who find it difficult to use a bedpan as well.

The use of the bed pan cushion, provides bedridden patients a means to increase their comfort and dignity at a time they need it the most.

Further, the present invention functions like a padded toilet seat by snapping onto existing bed pans to provide for greater patient comfort.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS

1. Detailed Description of the Figures

Figure 1:
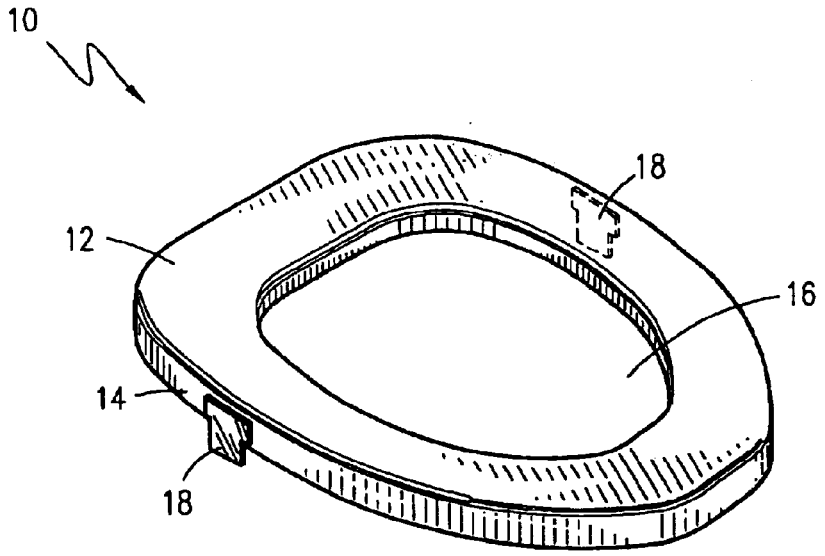
FIG. 1 is a perspective of a cushioned bed pan seat cover.
Figure 2:
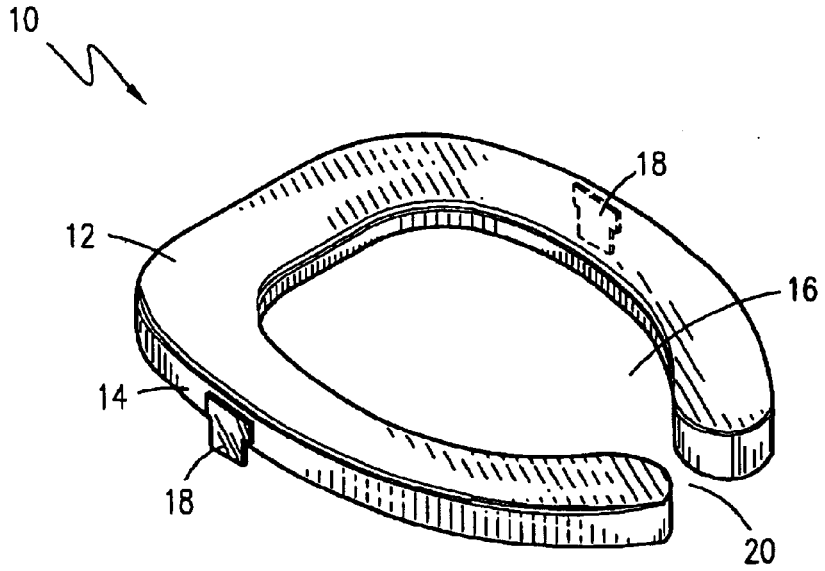
FIG. 2 is a perspective of a C-shaped cushioned bed pan seat cover, an alternative embodiment to the apparatus shown in FIG. 1.
Figure 3:
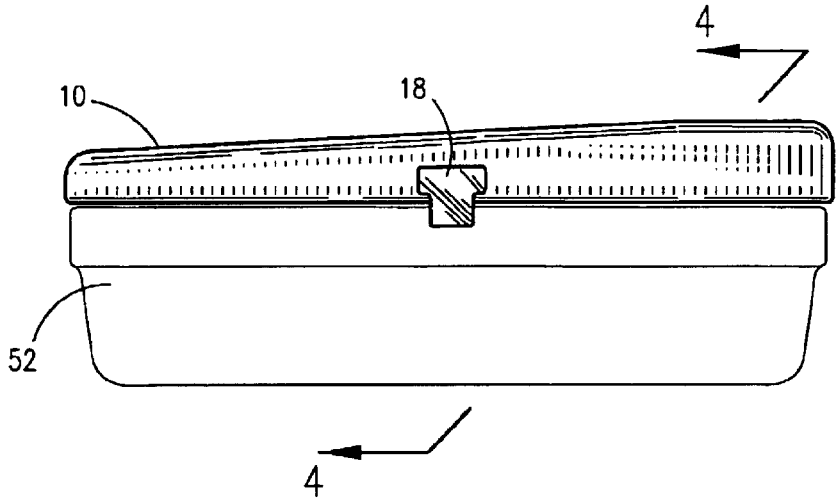
FIG. 3 is a side view of the apparatus of FIG. 1 illustrating the bed pan seat cover attached to a standard bed pan.

Referring now to FIG. 1, FIG. 2 and FIG. 3, a cushioned bed pan seat cover 10 is shown, in accordance with the present invention, and includes an arcuate outer surface 12 integral with a planar bottom surface 14 which form a curvilinear opening 16 and house plurality of snaps 18. FIG. 2 reflects an alternative embodiment of a cushioned bed pan seat cover 10 in which the front portion is open and articulates a C-shaped cushioned bed pan seat cover 10. FIG. 3 illustrates the cushioned bed pan seat cover 10 fastened to a standard bed pan 54 by way of a snap 18.

Figure 4:
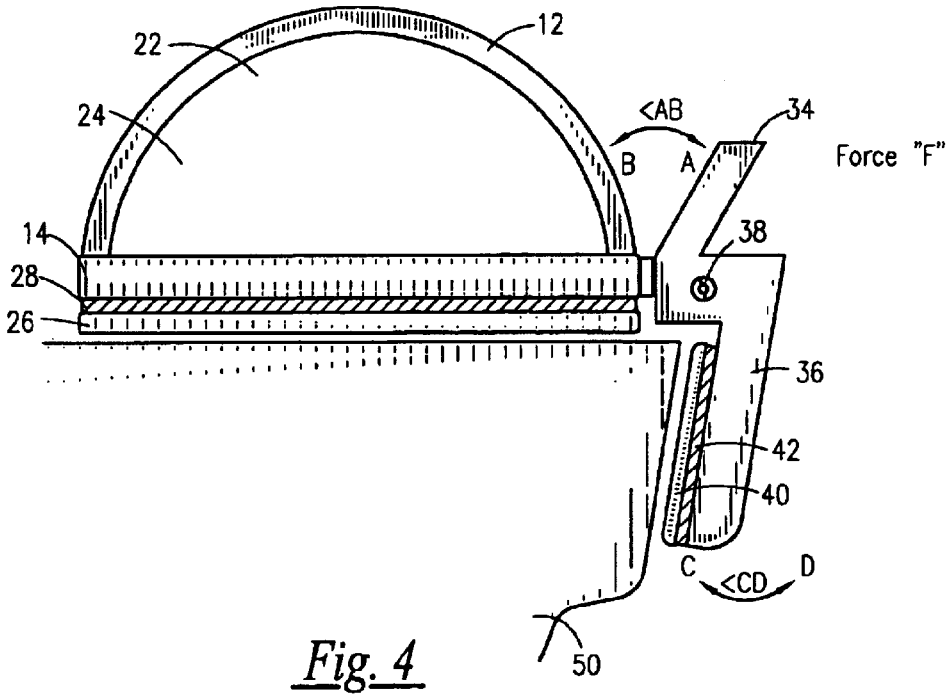
FIG. 4 is a cross-sectional view of the apparatus of FIG. 3 taken through line 4—4 and enlarged to illustrate the detail of the side snap.
Figure 5:
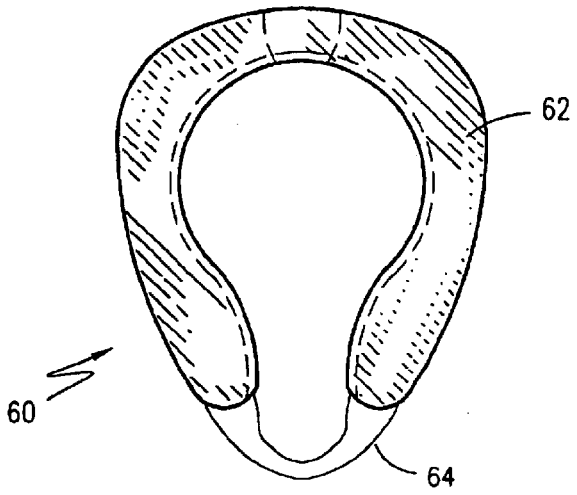
FIG. 5 is a top plan view of a second alternate embodiment of a cushioned bed pan incorporating the combination as an integral structure.
Figure 6:
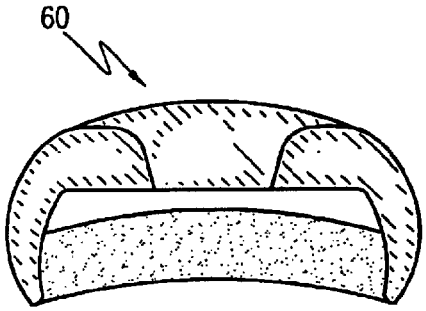
FIG. 6 is a front elevational view of the embodiment shown in FIG. 5.
Figure 7:
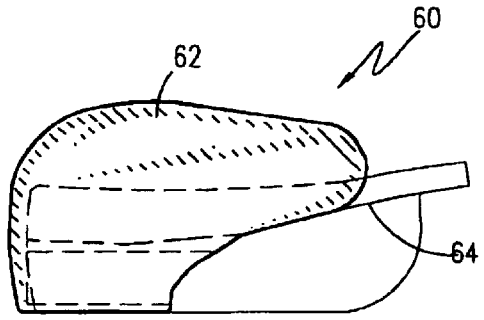
FIG. 7 is a side elevational view of the embodiment shown in FIG. 5.
Figure 8:
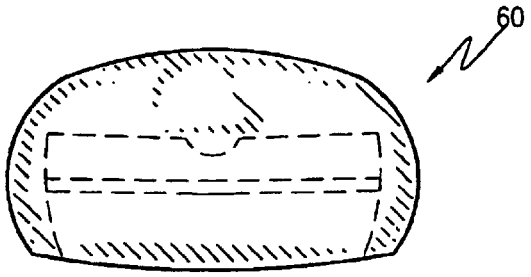
FIG. 8 is a rear elevational view of the embodiment shown in FIG. 5.

Referring now to FIG. 4, the cushioned bed pan seat cover 10 includes an arcuate outer surface 12 integral with a planar bottom surface 14 forming a padding space 22 which is filled with a suitable padding material 24, such as foam, cellulose fibers or other similar materials. The arcuate outer surface 12 is manufactured from an expandable, yet durable, material, such as vinyl or another similar substance. The planar bottom surface 14 is preferably manufactured from a slightly more rigid material than the expandable arcuate outer surface 12, so as to provide a weight bearing structural support for the cushioned bed pan seat cover 10 and to prevent the ridges or edges of the bed pan 54 from puncturing or otherwise compromising the integrity of the cushioned bed pan seat cover 10. The planar bottom surface 14 includes a gripping strip 26, manufactured from rubber or a similar material, to provide resistance against reciprocating movement, which includes lateral side-to-side movement and longitudinal front-to-back movement. The gripping strip 26 is affixed to the planar bottom surface 14 by way of an appropriate adhesive 28.

A plurality of snaps 30 are affixed along the outside of the planar bottom surface 14 by way of an appropriate adhesive, 32. A snap 30 includes a winged member 34 integral with a clasping arm 36. A snap 30 pivots about an internal spring 38 so that when sufficient force F is applied in the direction toward the cushioned bed pan seat cover 10, the winged member 34 is moved along the angle AB and the clasping arm 36 is moved along the angle CD. When the force F is removed, the winged member 34 returns to a position corresponding to point A and the clasping arm 36 returns to a position corresponding to point C. A snap gripping strip 40, manufactured from rubber or another similar substance, is affixed to the inner surface of the clasping arm 36 by way of an appropriate adhesive 42. The snap gripping strip 40, much like the gripping strip 26, supplies sufficient force to the side wall of the bed pan 54 and acts to securely hold the cushioned bed pan seat cover 10 in place and prevent movement that may cause waste spills or accidents.

F is removed, the winged member 34 returns to a position corresponding to point A and the clasping arm 36 returns to a position corresponding to point C. A snap gripping strip 40, much like the gripping strip 26, supplies sufficient force to the side wall of the bed pan 54 and acts to securely hold the cushioned bed pan seat cover 10 in place and prevent movement that may cause waste spills or accidents.

Referring now to FIG. 5–8, a second alternate embodiment is shown in which a cushioned bed pan seat cover 60 is shown and includes a padded upper outer surface 62 integral with rigid lower bedpan 64 as a one-piece, integral, non-removable structure.

2. Operation of the Preferred Embodiment

A user will position the cushioned bed pan seat cover 10 over a bed pan 50, aligning the front, back and side with one another. The user will apply sufficient force F to move the snap 30 along the angles of AB and CD, allowing the user to place the cushioned bed pan seat cover 10 directly on top of the bed pan 50. The gripping strip 26 rests against the top planar portions of the bed pan 50 and resists reciprocating movements. The user then removes the force F from the snap 30, allowing the snap 30 to return to positions A and C, with the clasping arm 36 and the corresponding snap gripping strip 40 resting against the side wall of the bed pan 50. Like the gripping strip 26, the snap gripping strip 40 acts to resist reciprocating movements.

To remove the cushioned bed pan seat cover 10 from the bed pan 50, a user will apply sufficient force F to move the snap 30 along the angles AB and CD, thereby releasing the resistant force applied by the snap 30 against the side wall of the bed pan 50. Once the resistant force of the snap 30 is released, the cushioned bed pan seat cover 10 may be removed from the bed pan 50.

In an alternative embodiment, in which clips 44 are used in place of snaps 18, the user will position the cushioned bed pan seat cover 10 so that the lip 56 of the bed pan 54 may slide into the space 52 formed within the clip(s) 44. To remove, the user simply slides the lip 56 away from the space 52 and the clip(s) 44.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A bed pan seat cover comprising:

an arcuate outer surface integral with a planar bottom surface and forming a padding space therebetween, said arcuate outer surface and said planar bottom surface forming an annular ring with a curvilinear opening for covering a bed pan;

padding material provided in said padding space;

a plurality of snaps affixed along the outside of said planar bottom surface, each one of said plurality of snaps spring-urged to impinge said bed pan seat cover against a bed pan;

each one of said plurality of snaps having a winged member integral with a clasping arm and an internal spring about which each one of said plurality of snaps pivots; and said spring biased to exert impingement on the outside of said bed pan, said spring displaced by application of sufficient force on said winged member, thereby permitting removal of said bed pan seat cover from said bed pan.

2. The bed pan seat cover of claim 1, wherein said padding material is a member selected from the group consisting of foam and cellulose fibers.

3. The bed pan seat cover of claim 1 further comprising a gripping strip affixed to said planar bottom surface.

4. The bed pan seat cover of claim 1, wherein said clasping arm comprises a snap gripping strip providing frictional impingement between said plurality of snaps and said bed pan.

5. A bed pan seat cover comprising:

an arcuate outer surface integral with a planar bottom surface and forming a padding space therebetween, said arcuate outer surface and said planar bottom surface forming an annular ring with a curvilinear opening for covering a bed pan, said arcuate outer surface comprising an returnably resilient, expandable material, said planar bottom surface comprising a rigid material to provide weight bearing structural support between said bed pan and a user;

padding material provided in said padding space; and a plurality of snaps affixed along the outside of said planar bottom surface, each one of said plurality of snaps spring-urged to impinge said bed pan seat cover against said bed pan, each one of said plurality of snaps comprising a snap gripping strip that provides frictional impingement between said plurality of snaps and said bad pan.

6. The bed pan seat cover of claim 5, wherein said padding material is a member selected from the group consisting of foam and cellulose fibers.

7. The bed pan seat cover of claim 5 further comprising a gripping strip affixed to said planar bottom surface and providing frictional impingement between said bed pan seat cover and said bed pan.

8. The bed pan seat cover of claim 5, wherein each one of said plurality of snaps comprises:

a winged member integral with a clasping arm;

an internal spring about which each one of said plurality of snaps pivots, said spring biased to exert impingement on outer surface of said bed pan, said spring displaced by application of sufficient force on said winged member, thereby permitting removal of said bed pan seat cover from said bed pan.

9. The bed pan seat cover of claim 8, wherein said clasping arm comprises a snap gripping strip that provides frictional impingement between said plurality of snaps and said bed pan.

10. A bed pan seat cover comprising:

an arcuate outer surface integral with a planar bottom surface and forming a padding space therebetween, said arcuate outer surface and said planar bottom surface forming an annular ring with a curvilinear opening for covering a bed pan;

padding material provided in said padding space;

a plurality of snaps affixed along the outside of said planar bottom surface, each one of said plurality of snaps spring-urged to impinge said bed pan seat cover against said bed pan;

each one of said plurality of snaps having a winged member integral with a clasping arm and an internal spring about which each one of said plurality of snaps pivots;

said spring biased to exert impingement on the outside of said bed pan, said spring displaced by application of sufficient force on said winged member, thereby permitting removal of said bed pan seat cover from said bed pan; and said clasping arm comprises a snap gripping strip providing frictional impingement between said plurality of snaps and said bed pan.

11. The bed pan seat cover of claim 10, wherein said padding material is a member selected from the group consisting of foam and cellulose fiber.

12. The bed pan seat cover of claim 10 further comprising a gripping strip affixed to said planar bottom surface.

* * * * *